United States Patent [19]

Cooke

[11] Patent Number: 4,760,982

[45] Date of Patent: Aug. 2, 1988

[54] APPARATUS FOR HOLDING A BAG OPEN

[75] Inventor: Ronald C. Cooke, Bellaire, Tex.

[73] Assignee: Bag Butler, Inc., Bellaire, Tex.

[21] Appl. No.: 28,107

[22] Filed: Mar. 19, 1987

[51] Int. Cl.[4] ..... B65B 67/04

[52] U.S. Cl. ..... 248/99; 141/316

[58] Field of Search ..... 248/99, 97, 101, 95, 248/174, 316.8; 141/316

[56] References Cited

U.S. PATENT DOCUMENTS

| | | | |
|---|---|---|---|
| 3,754,785 | 8/1973 | Anderson | 248/99 X |
| 4,664,348 | 5/1987 | Corsaut et al. | 248/99 |
| 4,669,689 | 6/1987 | Jones | 248/99 |

FOREIGN PATENT DOCUMENTS

| | | | |
|---|---|---|---|
| 2029696 | 3/1980 | United Kingdom | 248/316.8 |

*Primary Examiner*—Ramon O. Ramirez

*Attorney, Agent, or Firm*—Bill B. Berryhill

[57] ABSTRACT

Apparatus for holding a bag open to assist in the filling thereof. The appartus may include a relatively rigid middle panel at the opposite edges of which are attached relatively rigid side panels. The side panels are attached by hinges which allow them to move, relative to the middle panel, from coplanar flat positions to positions substantially perpendicular thereto, allowing insertion of the apparatus into a bag. The side panels are preferably biased away from the perpendicular positions toward the coplanar flat position so that when inserted into the bag, the bag is automatically held open by the apparatus.

9 Claims, 1 Drawing Sheet

APPARATUS FOR HOLDING A BAG OPEN

BACKGROUND OF THE INVENTION

1. Field of the Invention

The present invention pertains to apparatus for facilitating and handling of conventional plastic trash bags and the like. Specifically, the present invention pertains to apparatus for holding a plastic trash bag open to assist in the filling thereof.

The conventional plastic trash bag, normally formed with extremely thin and flexible plastic, i.e. low density polyethylene, is in great use. It is used for a variety of purposes around the home and elsewhere. The widespread acceptance of use of such bags proves their basic practicality. However, due to the extremely flexible or plastic nature of such bags, they are difficult to fill and handle and easily torn when certain sharp materials are packed therein. This is particularly true of bags filled with leaves, limbs and other yard debris.

Various devices have been designed to facilitate the filling and handling of such plastic trash bags. In fact, there are numerous designs. Some of these are shown in U.S. Pat. Nos. 3,734,340; 3,754,785; 3,822,524; 4,133,356 and 4,312,531. While most of these devices do aid in the filling of plastic trash bags, they have various deficiencies: too complex, lack of flexibility in use, bulkly and uneasy to store, expensive to manufacture, nondurable, etc. The fact that developments continue is an indication that the search continues for better apparatus in this area.

SUMMARY OF THE PRESENT INVENTION

In the present invention apparatus is provided for holding a bag open to assist in the filling thereof which is extremely simple in construction. The apparatus may comprise a relatively rigid panel to the opposite edges of which are attached relatively rigid side panels. The side panels are so attached as to be movable, relative to the middle panel, from a coplanar flat position to positions substantially perpendicular thereto, allowing insertion of the apparatus into a plastic trash bag. Each of the side panels is biased away from the perpendicular positions toward the flat position so that when inserted into the bag, the bag is automatically held open by the apparatus. The bag can then be laid on its side and filled by sweeping or raking materials thereinto or stood on end and filled in much the same fashion as a waste basket. Various other features of the invention further aid in facilitating the filling of the plastic trash bag.

The apparatus of the present invention automatically holds a trash bag open and, when the bag is placed on its side, allows the bag to be easily filled by one person and without excessive bending. The apparatus is simple in design and is made of extremely durable material. In fact, it is almost indestructable. The apparatus is easily stored when not in use and in so doing takes up almost no space. It is, of course, easy to use. Many other objects and advantages of the invention will be seen from reading the description which follows in conjunction with the accompanying drawings.

DESCRIPTION OF A PREFERRED EMBODIMENT

Figure 1:
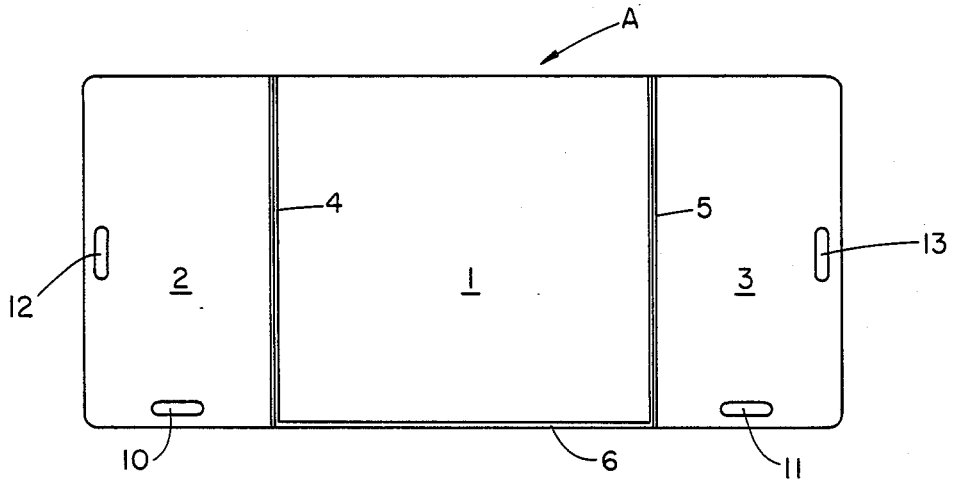
FIG. 1 is a plan view of the apparatus of the present invention in its flat position, according to a preferred embodiment thereof.
Figure 2:
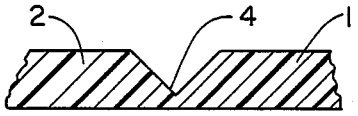
FIG. 2 is a cross-sectional detail of a portion of the present invention, according to a preferred embodiment thereof.
Figure 3:
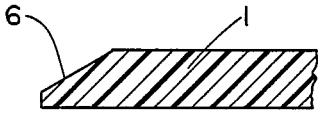
FIG. 3 is another cross-sectional detail of a portion of the present invention, according to a preferred embodiment thereof.

Referring first to FIGS. 1, 2 and 3 there is shown apparatus A for holding a bag open and assisting in the filling thereof. The apparatus A may include a relative rigid middle panel 1 at the opposite edges of which are attached relative rigid side panels 2 and 3. In the preferred embodiment, the panels 1, 2 and 3 are formed from a single sheet of material, such as a flat sheet of polypropylene. As illustrated, the panels 1, 2 and 3 are preferrably rectangular in shape and together form a larger rectangle,the corners of which might be slightly rounded.

Figure 4:
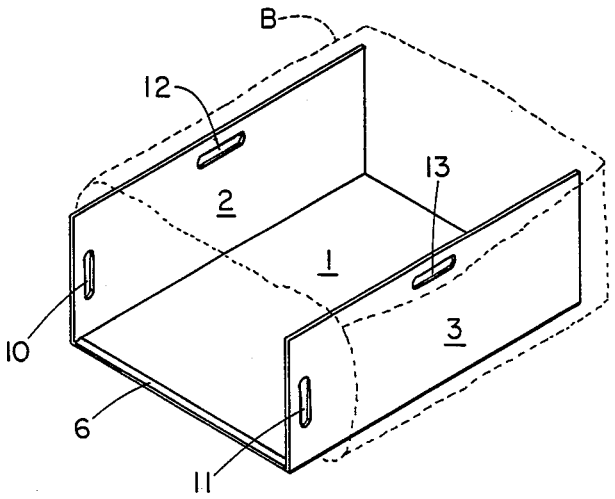
FIG. 4 is a perspective view of the apparatus of the present invention, illustrated in holding a trash bag open while lying on its side.
Figure 5:
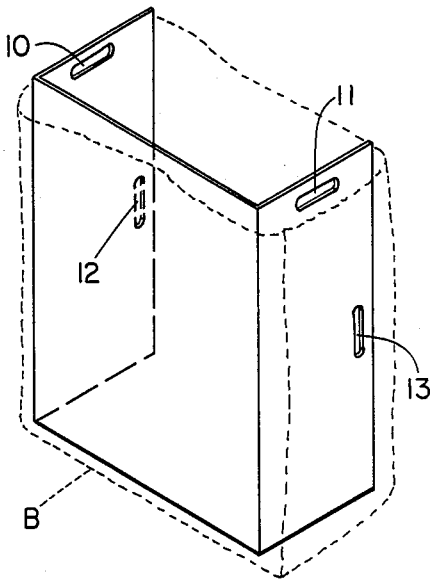
FIG. 5 is a perspective view of the apparatus of the present holding a trash bag open in the upright position.

While the panel members 1, 2 and 3 may all be formed from a single sheet, they are joined by hinge means 4 and 5 in such a way that the side panels 2, 3 are movable, relative to the middle panel 1, from coplanar flat positions to position substantially perpendicular thereto, allowing insertion of the apparatus in a trash bag B, such as shown in FIGS. 4 and 5. In the preferred embodiment, these hinges 4 and 5 are provided simply by cutting elongated grooves so as to separate the side panels 2 and 3 from the middle panel 1. In the preferred embodiment, the grooves are V-shaped in cross-section, such as shown at 4 in FIG. 2. Alternatively, the panels 1, 2 and 3 may be separate pieces joined by a more conventional type hinge. In any event, it is preferrable that the hinge means 4 be one which biases the side panels 2 and 3 away from the substantially perpendicular positions of FIGS. 4 and 5 toward the normal flat or coplanar postions of FIG. 1. The V-shaped groove 4 shown in FIG. 2 accomplishes this, e.g. by allowing the panel 2 to be forced to a perpendicular position, such as in FIG. 4, while placing the fibers of the material at the point of the V in tension. When the force is released, the panel 2 naturally springs back toward its flat or normal position.

At least one of the free edges of the middle panel 1 may be beveled, such as shown at 6 in FIG. 1 and FIG. 3, so that when the middle panel is lying on the ground, as in FIG. 4, an inclined lip is provided to aid in sweeping materials into the bag B. At least one hole may be provided near the outer edge of at least one of the side panels 2 and 3 for handling the apparatus A. In the exemplary embodiment, four such holes 10, 11, 12 and 13 are provided. These holes are provided for the hand or hands of the user and may also be used to hang the apparatus A by a hook, nail or the like. It can be easily seen that in the flat position of FIG. 1, the apparatus A can be hung against a wall occupying almost no space.

In use with a plastic trash bag, illustrated by the dotted line B in FIGS. 4 and 5, the side panels 2 and 3 of the apparatus A are moved from their flat positions of FIG. 1 to substantially perpendicular positions of FIG. 4, allowing the apparatus to be inserted into the bag B as shown in FIG. 4. It will be noted that the length of the apparatus A from the free edge of one of the side panels 2 to the free edge of the other side panel 3 is greater than one half the circumference of the bag B but less than its circumference. Once the apparatus is inserted into the bag B, the side panels 2 and 3 may be released and since they are biased, by hinge means 4 and 5, toward the flat position of FIG. 1, they spring out against bag B automatically holding the bag open, as illustrated in FIG. 4. The bag may be placed on its side, as shown in FIG. 4, and filled with leaves, debris of whatever material the bag is to be filled with. The beveled edge or lip 6 aids in this step. After the bag is filled, the apparatus A may be removed therefrom, the bag tied for disposition and the apparatus A reused or stored away.

The apparatus A may also be used as shown in FIG. 5, in the same manner as in upright waste basket or garbage can. This is simply done by placing the bag B in its upright position so that the panels of the apparatus are all vertical. After the bag B is filled, the apparatus A may be removed for subsequent use.

As seen from the foregoing description, the apparatus of the present invention is extremely simple in construction. However, it is unique and unusually easy to use. It is relatively inexpensive and almost indestructable. One person may easily fill a bag with the apparatus of the present invention, eliminating much of the bending over associated with filling of a trash bag.

A single embodiment of the present invention has been described herein. However, many variations thereof may be made without departing from the spirit of the invention. Accordingly, it is intended that the scope of the invention be limited only by the claims which follow.

I claim:

1. Portable apparatus for holding open bags of varied sizes to assist in the filling thereof, said apparatus comprising: a relatively rigid middle panel at opposite edges of which are attached, by hinge means, relatively rigid side panels, each of said side panels being movable, relative to said middles panel, from a coplanar flat position to a position substantially perpendicular thereto, allowing insertion of said apparatus into a bag to protect the interior thereof and assist in the filling thereof, each of said side panels being biased toward said flat positions by said hinge means so that when inserted into said bag, said bag is automatically held open by said apparatus.

2. The apparatus as set forth in claim 1 in which said middle and side panels are formed from a single sheet of plastic material, said hinge means comprising elongated grooves which separate said middle panel from each of said side panels.

3. The apparatus of claim 2 in which said grooves are V-shaped in cross-section.

4. The apparatus of claim 1 in which at least one of the free edges of said middle panel not connected to said side panels is beveled so that upon insertion of said apparatus into said bag, with said middle panel lying on the ground or any other relatively flat surface, an inclined lip is provided to aid in sweeping materials into said bag.

5. The apparatus of claim 1 in which at least one hole is provided near an outer edge of at least one of said side panels for handling of said apparatus.

6. Portable apparatus for holding open bags of varied sizes to assist in the filling thereof, said apparatus comprising: a relatively rigid rectangular middle panel at opposite edges of which are relatively rigid side panels, each of said side panels being hingedly attached along a corresponding edge of said middle panel in such a manner as to allow said side panels to move from a normal coplanar position, relative to said middle panel, to other positions substantially perpendicular thereto, allowing insertion of said apparatus into said bag to hold said bag open, each of said side panels being biased toward said normal coplanar position so that when inserted into said bag said bag is automatically held open by said apparatus.

7. The apparatus of claim 6 in which said side panels are attached to said middle panel by hinge means, said hinge means biasing said side panels away from said other positions toward said normal positions.

8. The apparatus of claim 7 in which said middle and side panels are formed from a single sheet of material said hinge means being provided by elongated grooves which define the edges of said middle panel and the corresponding side panel.

9. The apparatus of claim 5 in which the length of said apparatus from the free edge of one of said side panels to the free edge of the other of said side panels is greater than one half the circumference of said bag but less than the circumference thereof.

* * * * *